US006299483B1

(12) United States Patent
Cohen et al.

(10) Patent No.: US 6,299,483 B1
(45) Date of Patent: Oct. 9, 2001

(54) HIGH SPEED HIGH DENSITY ELECTRICAL CONNECTOR

(75) Inventors: Thomas S. Cohen, New Boston, NH (US); Philip T. Stokoe, Attleboro, MA (US); David M. McNamara, Amherst, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/389,853

(22) Filed: Aug. 26, 1999

Related U.S. Application Data

(62) Division of application No. 08/797,540, filed on Feb. 7, 1997, now Pat. No. 5,980,321.

(51) Int. Cl.[7] ..... H01R 13/648
(52) U.S. Cl. ..... 439/608; 439/609
(58) Field of Search ..... 439/607–610, 439/108

(56) References Cited

U.S. PATENT DOCUMENTS 4,768,961 * 9/1988 Lau ..... 439/490
4,976,628 * 12/1990 Fedder ..... 439/610
5,496,183 * 3/1996 Soes et al. ..... 439/607
5,664,968 * 9/1997 Mickievicz ..... 439/609

* cited by examiner

*Primary Examiner*—Hien Vu

(57) ABSTRACT

A high speed, high density electrical connector for use with printed circuit boards. The connector is in two pieces with one piece having pins and shield plates and the other having socket type signal contacts and shield plates. The shields have a grounding arrangement which is adapted to control the electromagnetic fields, for various system architectures, simultaneous switching configurations and signal speeds, allowing all of the socket type signal contacts to be used for signal transmission. Additionally, at least one piece of the connector is manufactured from wafers, with each ground plane and signal column injection molded into components which, when combined, form a wafer. This construction allows very close spacing between adjacent columns of signal contacts as well as tightly controlled spacing between the signal contacts and the shields. It also allows for easy and flexible manufacture, such as a connector that has wafers intermixed in a configuration to accommodate single ended, point to point and differential applications.

13 Claims, 11 Drawing Sheets

HIGH SPEED HIGH DENSITY ELECTRICAL CONNECTOR

This application is a divisional of application Ser. No. 08/797,540, filed on Feb. 7, 1997 now U.S. Pat. No. 5,980, 321.

This invention relates generally to electrical connectors used to interconnect printed circuit boards and more specifically to a method of simplifying the manufacture of such connectors.

Electrical connectors are used in many electronic systems. It is generally easier and more cost effective to manufacture a system on several printed circuit boards which are then joined together with electrical connectors. A traditional arrangement for joining several printed circuit boards is to have one printed circuit board serve as a backplane. Other printed circuit boards, called daughter boards, are connected through the backplane.

A traditional backplane is a printed circuit board with many connectors. Conducting traces in the printed circuit board connect to signal pins in the connectors so that signals may be routed between the connectors. Other printed circuit boards, called "daughter boards" also contain connectors that are plugged into the connectors on the backplane. In this way, signals are routed among the daughter boards through the backplane. The daughter cards often plug into the backplane at a right angle. The connectors used for these applications contain a right angle bend and are often called "right angle connectors."

Connectors are also used in other configurations for interconnecting printed circuit boards, and even for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards of the same size are sometimes aligned in parallel. Connectors used in these applications are sometimes called "stacking connectors" or "mezzanine connectors."

Regardless of the exact application, electrical connector designs have generally needed to mirror trends in the electronics industry. Electronic systems generally have gotten smaller and faster. They also handle much more data than systems built just a few years ago. To meet the changing needs of these electronic systems, some electrical connectors include shield members. Depending on their configuration, the shields might control impedance or reduce cross talk so that the signal contacts can be placed closer together.

An early use of shielding is shown in Japanese patent disclosure 49-6543 by Fujitsu, Ltd. dated Feb. 15, 1974. U.S. Pat. Nos. 4,632,476 and 4,806,107—both assigned to AT&T Bell Laboratories—show connector designs in which shields are used between columns of signal contacts. These patents describe connectors in which the shields run parallel to the signal contacts through both the daughter board and the backplane connectors. Cantilevered beams are used to make electrical contact between the shield and the backplane connectors. U.S. Pat. Nos. 5,433,617; 5,429,521; 5,429,520 and 5,433,618—all assigned to Framatome Connectors International—show a similar arrangement. The electrical connection between the backplane and shield is, however, made with a spring type contact.

Other connectors have the shield plate within only the daughter card connector. Examples of such connector designs can be found in U.S. Pat. Nos. 4,846,727; 4,975,084; 5,496,183; 5,066,236—all assigned to AMP, Inc. An other connector with shields only within the daughter board connector is shown in U.S. Pat. No. 5,484,310, assigned to Teradyne, Inc.

Another modification made to connectors to accomodate changing requirements is that connectors must be much larger. In general, increasing the size of a connector means that manufacturing tolerances must be much tighter. The permissible mismatch between the pins in one half of the connector and the receptacles in the other is constant, regardless of the size of the connector. However, this constant mismatch, or tolerance, becomes a decreasing percentage of the connector's overall length as the connector gets larger. Therefore, manufacturing tolerances must be tighter for larger connectors, which can increase manufacturing costs. One way to avoid this problem is to use modular connectors. Teradyne Connection Systems of Nashua, N.H., USA pioneered a modular connector system called HD+®, with the modules organized on a stiffener. Each module had multiple columns of signal contacts, such as 15 or 20 columns. The modules were held together on a metal stiffener.

An other modular connector system is shown in U.S. Pat. Nos. 5,066,236 and 5,496,183. Those patents describe "module terminals" with a single column of signal contacts. The module terminals are held in place in a plastic housing module. The plastic housing modules are held together with a one-piece metal shield member. Shields could be placed between the module terminals as well.

It would be highly desirable if a modular connector could be made with an improved shielding configuration. It would also be desirable if the manufacturing operation were simplified. It would be further desirable if a design could be developed that allowed easy intermixing of single ended and differential signal contacts.

SUMMARY OF THE INVENTION

With the foregoing background in mind, it is an object of the invention to provide a high speed, high density connector.

It is a further object to provide a modular connector that is easy to manufacture.

It is a further object to provide a low insertion force connector.

It is also an object to provide a connector that can be easily assmebled to include signal contacts configured for single end or differential signals.

The foregoing and other objects are achieved in an electrical connector manufactured from a plurality of wafers. Each wafer is made with a ground plane insert molded into a housing. The housing has cavities into which signal contacts are inserted.

In a preferred embodiment, the signal contacts are also insert molded into a second housing piece. The two housing pieces snap together to form one wafer. The wafers are held together on a metal stiffener.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
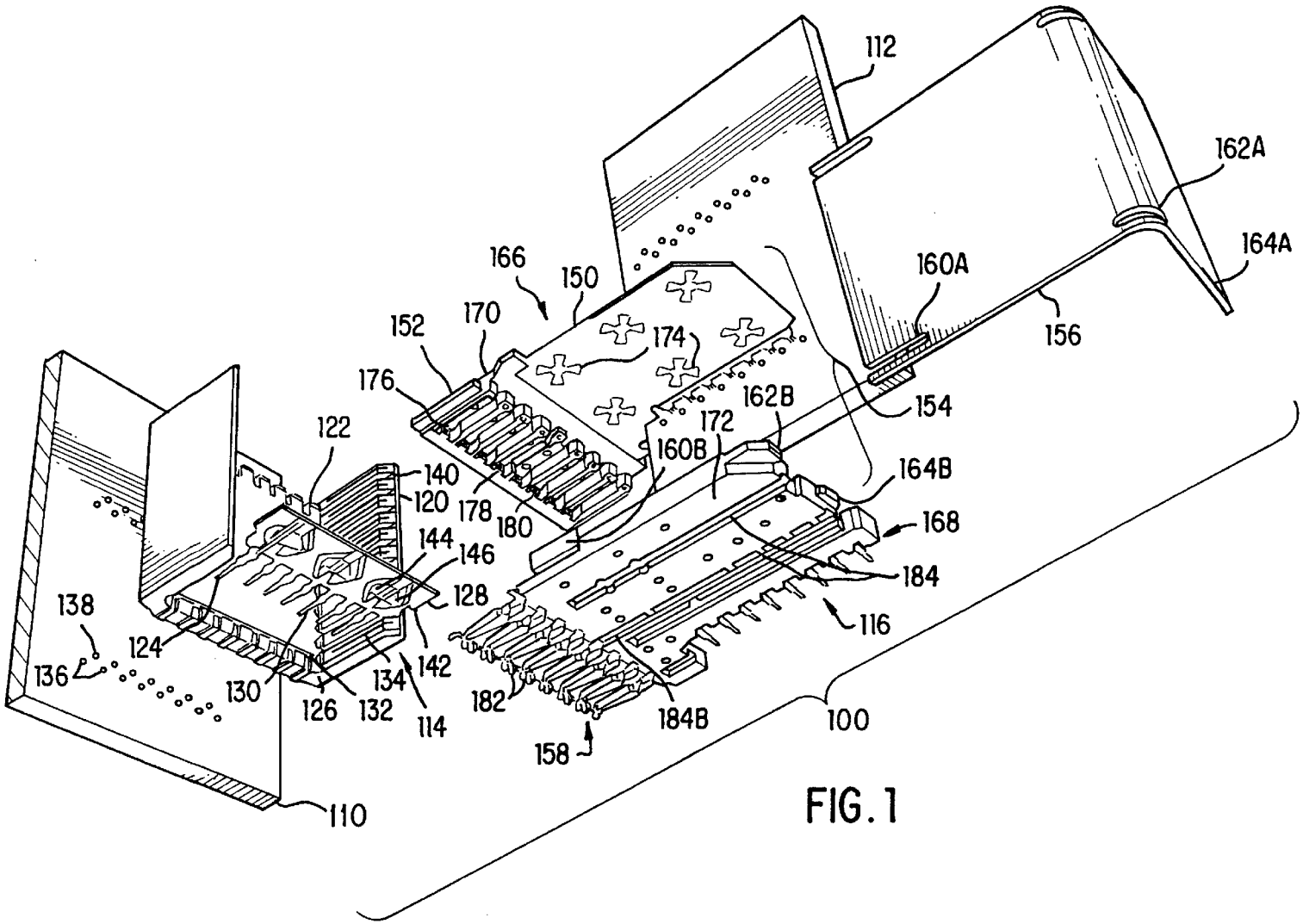
FIG. 1 is an exploded view of a connector made in accordance with the invention.

FIG. 1 shows an exploded view of backplane assembly 100. Backplane 110 has pin header 114 attached to it. Daughter card 112 has daughter card connector 116 attached to it. Daughter card connector 116 can be mated to pin header 114 to form a connector. Backplane assembly likely has many other pin headers attached to it so that multiple daughter cards can be connected to it. Additionally, multiple pin headers might be aligned end to end so that multiple pin headers are used to connect to one daughter card. However, for clarity, only a portion of backplane assembly and a single daughter card 112 are shown.

Pin header 114 is formed from shroud 120. Shroud 120 is preferably injection molded from a plastic, polyester or other suitable insulative material. Shroud 120 serves as the base for pin header 114.

The floor (not numbered) of shroud 120 contains columns of holes 126. Pins 122 are inserted into holes 126 with their tails 124 extending through the lower surface of shroud 120. Tails 124 are pressed into signal holes 136. Holes 136 are plated through-holes in backplane 110 and serve to electrically connect pins 122 to traces (not shown) on backplane 110. For clarity of illustration, only a single pin 122 is shown. However, pin header 114 contains many parallel columns of pins. In a preferred embodiment, there are eight rows of pins in each column.

The spacing between each column of pins is not critical. However, it is one object of the invention to allow the pins to be placed close together so that a high density connector can be formed. By way of example, the pins within each column can be spaced apart by 2.25 mm and the columns of pins can be spaced apart by 2 mm. Pins 122 could be stamped from 0.4 mm thick copper alloy.

Shroud 120 contains a groove 132 formed in its floor that runs parallel to the column of holes 126. Shroud 120 also has grooves 134 formed in its sidewalls. Shield plate 128 fits into grooves 132 and 134. Tails 130 protrude through holes (not visible) in the bottom of groove 132. Tails 130 engage ground holes 138 in backplane 110. Ground holes 138 are plated through-holes that connect to ground traces on backplane 110.

In the illustrated embodiment, plate 128 has seven tails 130. Each tail 130 falls between two adjacent pins 122. It would be desirable for shield 128 to have a tail 130 as close as possible to each pin 122. However, centering the tails 130 between adjacent signal pins 122 allows the spacing between shield 128 and a column of signal pins 122 to be reduced.

Shield plate 128 has several torsional beams contacts 142 formed therein. Each contact 142 is formed by stamping arms 144 and 146 in plate 128. Arms 144 and 146 are then bent out of the plane plate 128. Arms 144 and 146 are long enough that they will flex when pressed back into the plane of plate 128. Arms 144 and 148 are sufficiently resilient to provide a spring force when pressed back into the plane of plate 128. The spring force generated by arms 144 and 146 creates a point of contact between each arm 144 or 146 and plate 150. The generated spring force must be sufficient to ensure this contact even after the daughter card connector 116 has been repeatedly mated and unmated from pin header 114.

During manufacture, arms 144 and 146 are coined. Coining reduces the thickness of the material and increases the compliancy of the beams without weakening of plate 128.

For enhanced electrical performance, it is desirable that arms 144 and 146 be as short and straight as possible. Therefore, they are made only as long as needed to provide the required spring force. In addition, for electrical performance, it is desirable that there be one arm 144 or 146 as close as possible to each signal pin 122. Ideally, there would be one arm 144 and 146 for each signal pin 122. For the illustrated embodiment with eight signal pins 122 per column, there would ideally be eight arms 144 or 146, making a total of four balanced torsional beam contacts 142. However, only three balanced torsional beam contacts 142 are shown. This configuration represents a compromise between the required spring force and desired electrical properties.

Grooves 140 on shroud 120 are for aligning daughter card connector 116 with pin header 114. Tabs 152 fit into grooves 140 for alignment and to prevent side to side motion of daughter card connector 116 relative to pin header 114.

Daughter card connector 116 is made of wafers 154. Only one wafer 154 is shown for clarity, but daughter card connector 116 has, in a preferred embodiment, several wafers stacked side to side. Each wafer 154 contains one column of receptacles 158. Each receptacle 158 engages one pin 122 when the pin header 114 and daughter card connector 116 are mated. Thus, daughter card connector 116 is made from as many wafers as there are columns of pins in pin header 114.

Wafers 154 are supported in stiffener 156. Stiffener 156 is preferably stamped and formed from a metal strip. It is stamped with features to hold wafer 154 in a required position without rotation and therefore preferably includes three attachment points. Stiffener 156 has slot 160A formed along its front edge. Tab 160B fits into slot 160A. Stiffener 156 also includes holes 162A and 164A. Hubs 162B and 164B fit into holes 162A and 164A. The hubs 162B and 164B are sized to provide an interference fit in holes 162A and 164A.

FIG. 1 shows only a few of the slots 160A and holes 162A and 164A for clarity. The pattern of slots and holes is repeated along the length of stiffener 156 at each point where a wafer 156 is to be attached.

Figure 4:
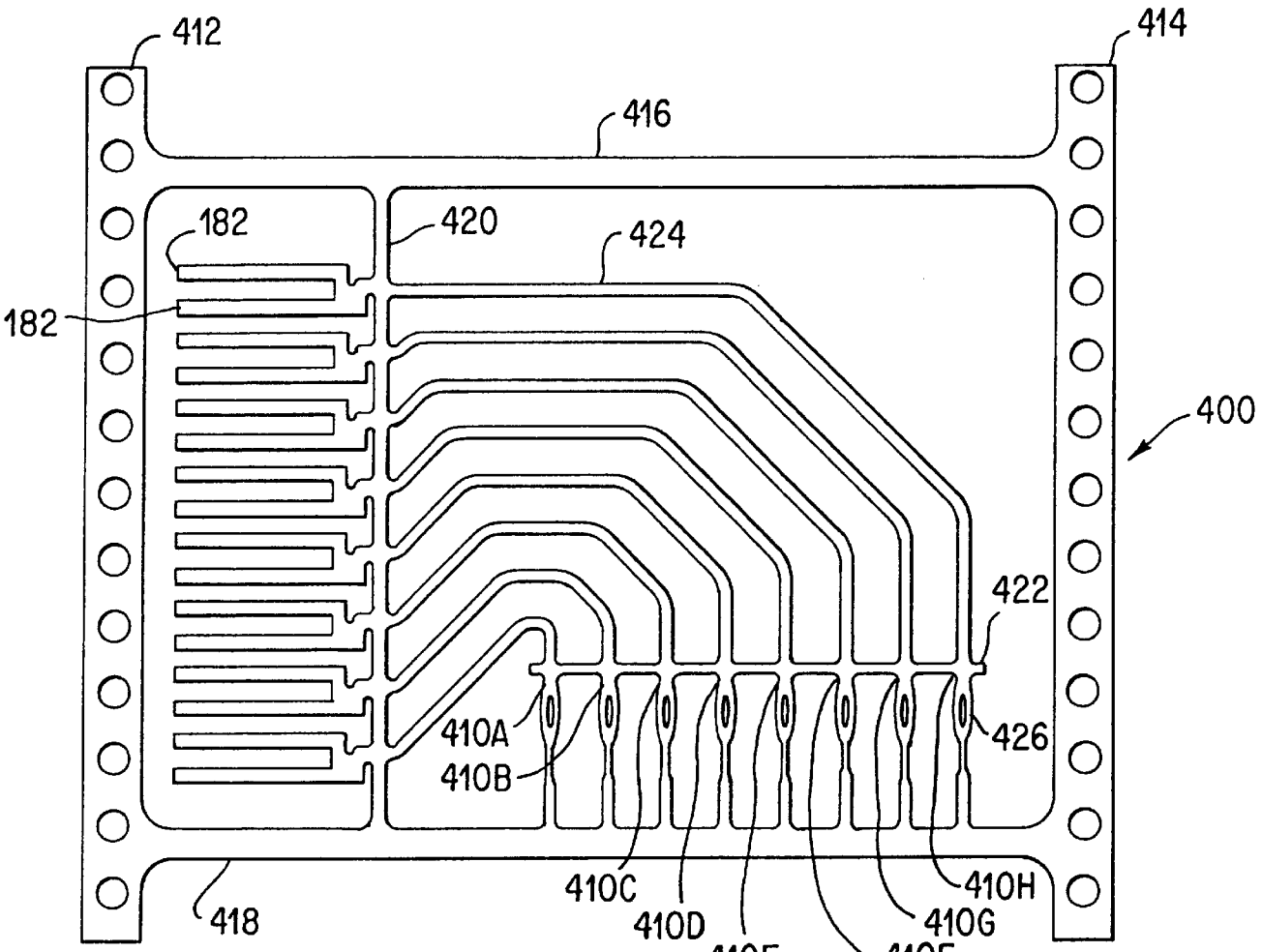
FIG. 4 is a signal contact blank used in the connector of FIG. 1.

In the illustrated embodiment, wafer 154 is made in two pieces, shield piece 166 and signal piece 168. Shield piece 166 is formed by insert molding housing 170 around the front portion of shield 150. Signal piece 168 is made by insert molding housing 172 around contacts 410A . . . 410H (FIG. 4).

Signal piece 168 and shield piece 166 have features which hold the two pieces together. Signal piece 168 has hubs 512 (FIG. 5) formed on one surface. The hubs align with and are inserted into clips 174 cut into shield 150. Clips 174 engage hubs 512 and hold plate 150 firmly against signal piece 168.

Housing 170 has cavities 176 formed in it. Each cavity 176 is shaped to receive one of the receptacles 158. Each cavity 176 has platform 178 at its bottom. Platform 178 has a hole 180 formed through it. Hole 180 receives a pin 122 when daughter card connector 116 mates with pin header 114. Thus, pins 122 mate with receptacles 158, providing a signal path through the connector.

Receptacles 158 are formed with two legs 182. Legs 182 fit on opposite sides of platform 178 when receptacles 158 are inserted into cavities 176. Receptacles 158 are formed such that the spacing between legs 182 is smaller than the width of platform 178. To insert receptacles 158 into cavity 176, it is therefore necessary to use a tool to spread legs 182.

The receptacles form what is known as a preloaded contact. Preloaded contacts have traditionally been formed by pressing the receptacle against a pyramid shaped platform. The apex of the platform spreads the legs as the receptacle is pushed down on it. Such a contact has a lower insertion force and is less likely to stub on the pin when the two connectors are mated. The receptacles of the invention provide the same advantages, but are achieved by inserting the receptacles from the side rather than by pressing them against a pyramid.

Housing 172 has grooves 184 formed in it. As described above, hubs 512 (FIG. 5) project through plate 150. When two wafers are stacked side by side, hubs 512 from one wafer 154 will project into grooves 184 of an adjacent wafer. Hubs 512 and grooves 184 help hold adjacent wafers together and prevent rotation of one wafer with respect to the next. These features, in conjunction with stiffener 156 obviate the need for a separate box or housing to hold the wafers, thereby simplifying the connector.

Housings 170 and 172 are shown with numerous holes (not numbered) in them. These holes are not critical to the invention. They are "pinch holes" used to hold plates 150 or receptacle contacts 410 during injection molding. It is desirable to hold these pieces during injection molding to maintain uniform spacing between the plates and receptacle contacts in the finished product.

Figure 2:
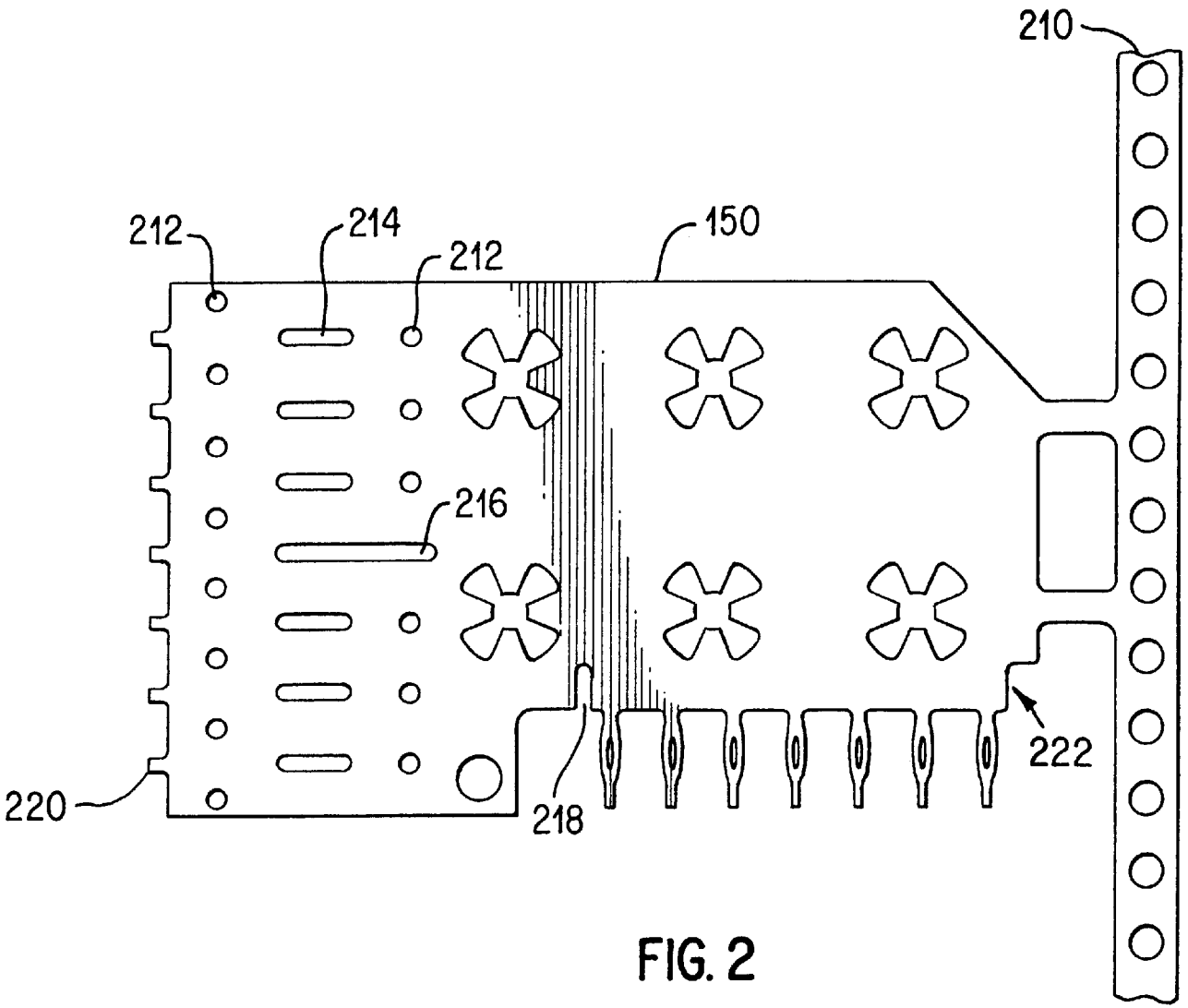
FIG. 2 is a shield plate blank used in the connector of FIG. 1.

FIG. 2 shows in greater detail the blank used to make plate 150. In a preferred embodiment, plates 150 are stamped from a roll of metal. The plates are retained on carrier strip 210 for ease of handling. After plate 150 is injection molded into a shield piece 166, the carrier strip can be cut off.

Plates 150 include holes 212. Holes 212 are filled with plastic from housing 170, thereby locking plate 150 in housing 170.

Plates 150 also include slots 214. Slots 214 are positioned to fall between receptacles 158. Slots 214 serve to control the capacitance of plate 150, which can overall raise or lower the impedance of the connector. They also channel current flow in the plate near receptacles 158, which are the signal paths. Higher return current flow near the signal paths reduces cross talk.

Slot 216 is similar to the slots 214, but is larger to allow a finger 316 (FIG. 3) to pass through plate 150 when plate 150 is molded into a housing 170. Finger 316 is a small finger of insulating material that could aid in holding a plate 128 against plate 150. Finger 316 is optional and could be omitted. Note in FIG. 1 that the central two cavities 176 have their intermediate wall partially removed. Finger 316 from an adjacent wafer 154 (not shown) would fit into this space to complete the wall between the two central cavities. Finger 316 would extend beyond housing 170 and would fit into a slot 184B of an adjacent wafer (not shown).

Figure 9A:
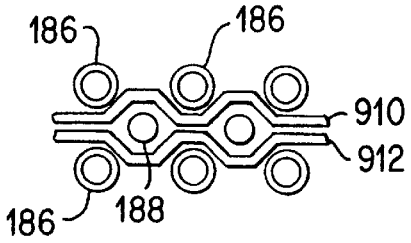
FIGS. 9A and 9B are backplane hole and signal trace patterns for single ended and differential embodiments of the invention, respectively.
Figure 9B:
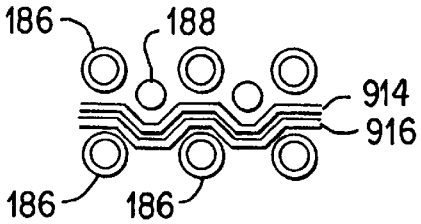

Slot 218 allows tail region 222 to be bent out of the plane of plate 150, if desired. FIG. 9A shows traces 910 and 912 on a printed circuit board routed between holes used to mount a connector according to the invention. FIG. 9A shows portions of a column of signal holes 186 and portions of a column of ground contacts 188. When the connector is used to carry single ended signals, it is desirable that the traces 910 and 912 be separated by ground to the greatest extent possible. Thus, it is desirable that the ground holes 188 be centered between the column of signal holes 186 so that the signal traces 910 and 912 can be routed between the signal holes 186 and ground holes 188. On the other hand, FIG. 9B shows the preferred routing for differential pair signals. For differential pair signals, it is desirable that the traces be routed as close together as possible. To allow the traces 914 and 916 to be close together, the ground holes 188 are not centered between columns of signal holes 186. Rather, they are offset to be as close to one row of signal contacts. That placement allows both signal traces 914 and 916 to be routed between the ground holes 188 and a column of signal holes 186. In the single ended configuration, tail region 222 is bent out of the plane of plate 150. For the differential configuration, it is not bent.

It should also be noted that plate 128 (FIG. 1) can be similarly bent in its tail region, if desired. In the preferred embodiment, though, plate 128 is not bent for single ended signals and is bent for differential signals.

Tabs 220 are bent out of the plane of plate 150 prior to injection molding of the housing 170. Tabs 220 will wind up between holes 180 (FIG. 1). Tabs 220 aid in assuring that plate 150 adheres to housing 170. They also reinforce housing 170 across its face, i.e. that surface facing pin header 114.

Figure 3:
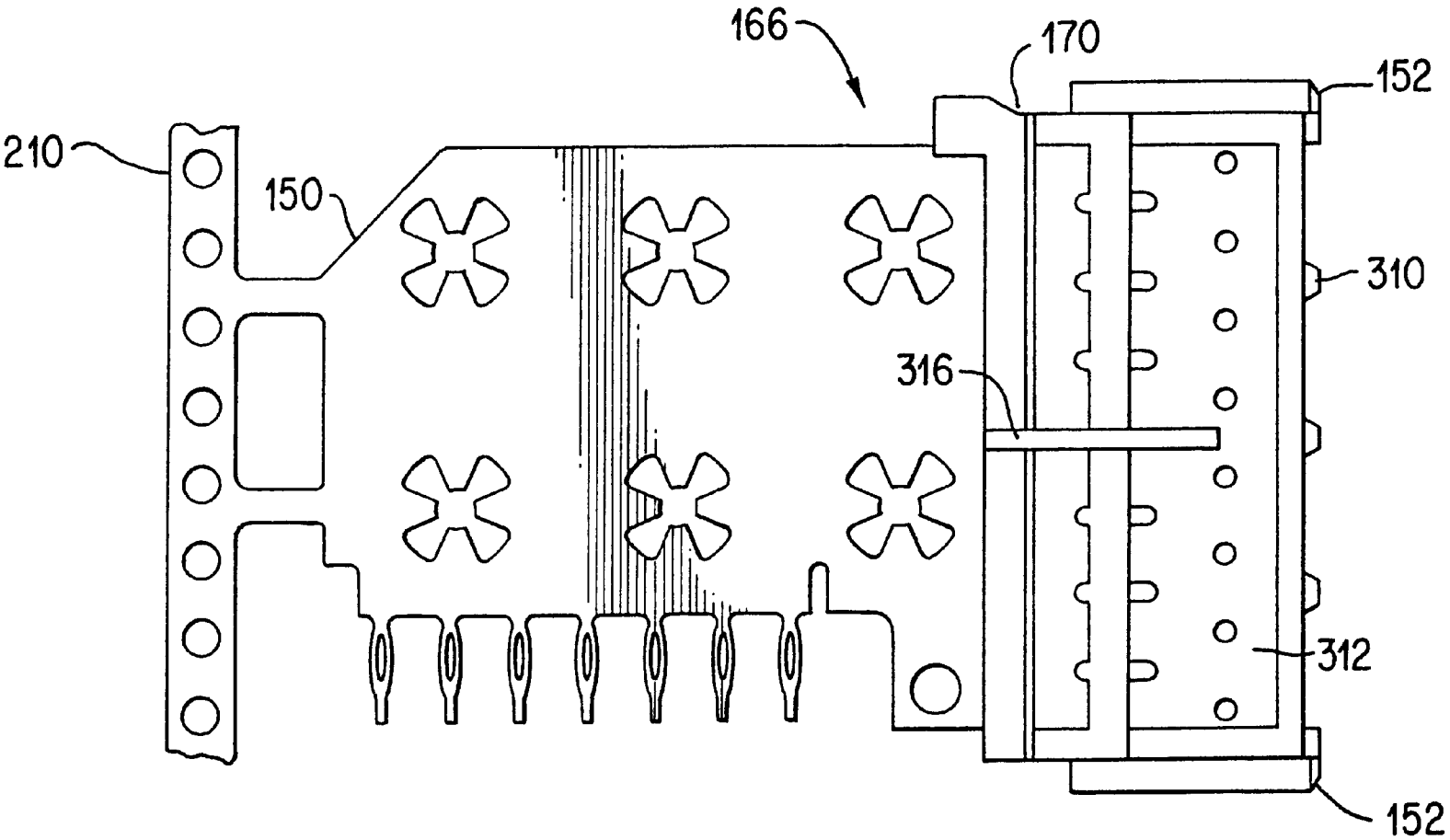
FIG. 3 is a view of the shield plate blank of FIG. 2 after it is insert molded into a housing element.

FIG. 3 shows shield 150 after it has been insert molded into housing 170 to form ground portion 166. FIG. 3 shows that housing 170 includes pyramid shaped projections 310 on the face of shield piece 166. Matching recesses (not shown) are included in the floor of pin header 114. Projections 310 and the matching recesses serve to prevent the spring force of torsional beam contacts 142 from spreading adjacent wafers 154 when daughter card connector 116 is inserted into pin header 114.

FIG. 4 shows receptacle contact blank 400. Receptacle contact blank is preferably stamped from a sheet of metal. Numerous such blanks are stamped in a roll. In the preferred embodiment, there are eight receptacle contacts 410A. . . 410H. The receptacle contacts 410 are held together on carrier strips 412, 414, 416, 418 and 422. These carrier strips are severed to separate contacts 410A . . . 410H after housing 172 has been molded around the contacts. The carrier strips can be retained during much of the manufacturing operation for easy handling of receptacle portions 168.

Each of the receptacle contacts 410A . . . 410H includes two legs 182. The legs 182 are folded and bent to form the receptacle 158.

Each receptacle contact 410A . . . 410H also includes a transmission region 424 and a tail region 426. FIG. 4 shows that the transmission regions 424 are equally spaced. This arrangement is preferred for single ended signals as it results in maximum spacing between the contacts.

FIG. 4 shows that the tail regions are suitable for being press fit into plated through-holes. Other types of tail regions might be used. For example, solder tails might be used instead.

Figure 5:
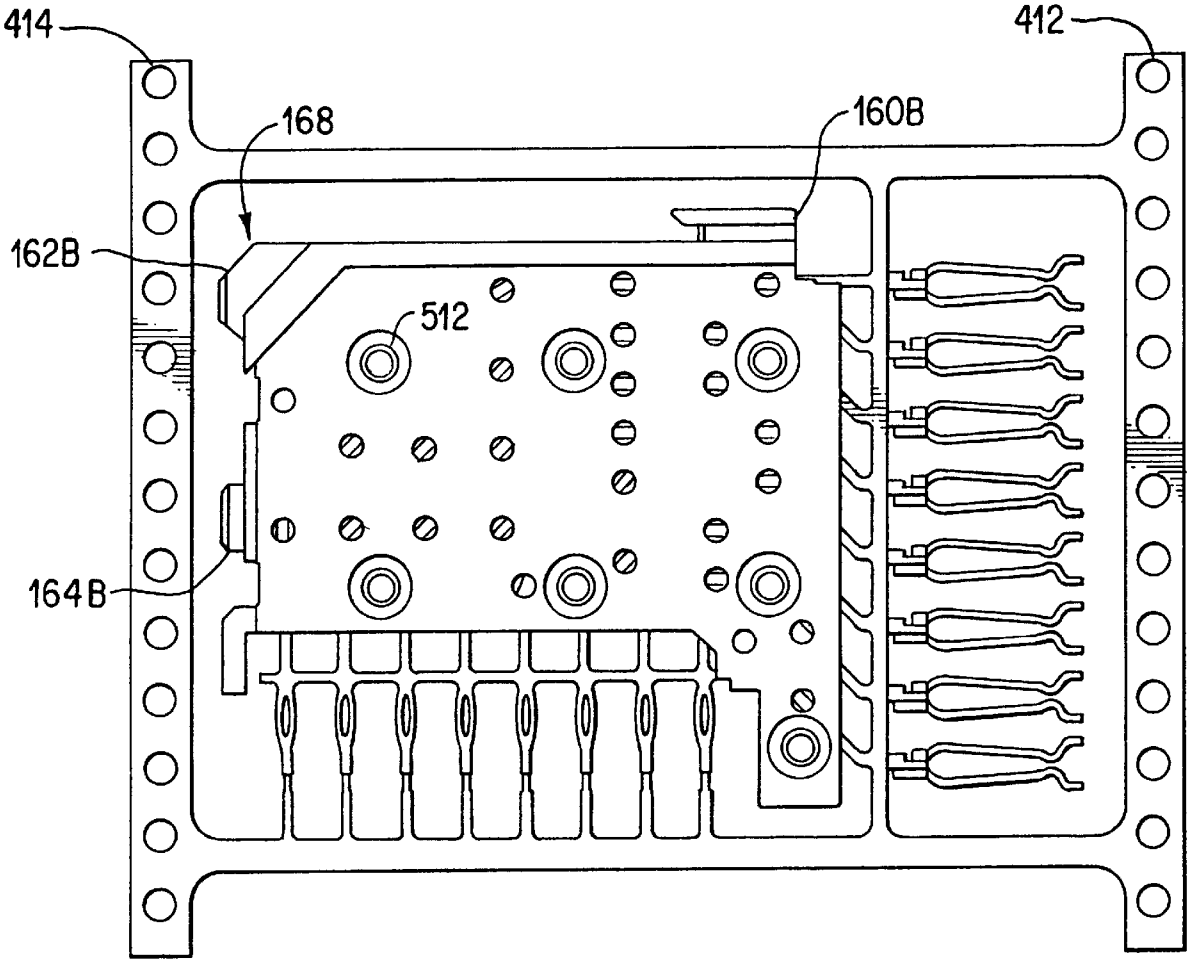
FIG. 5 is a view of the signal contact blank of FIG. 4 after it is insert molded into a housing element.

FIG. 5 shows receptacle contact blank 400 after housing 172 has been molded around it.

Figure 6:
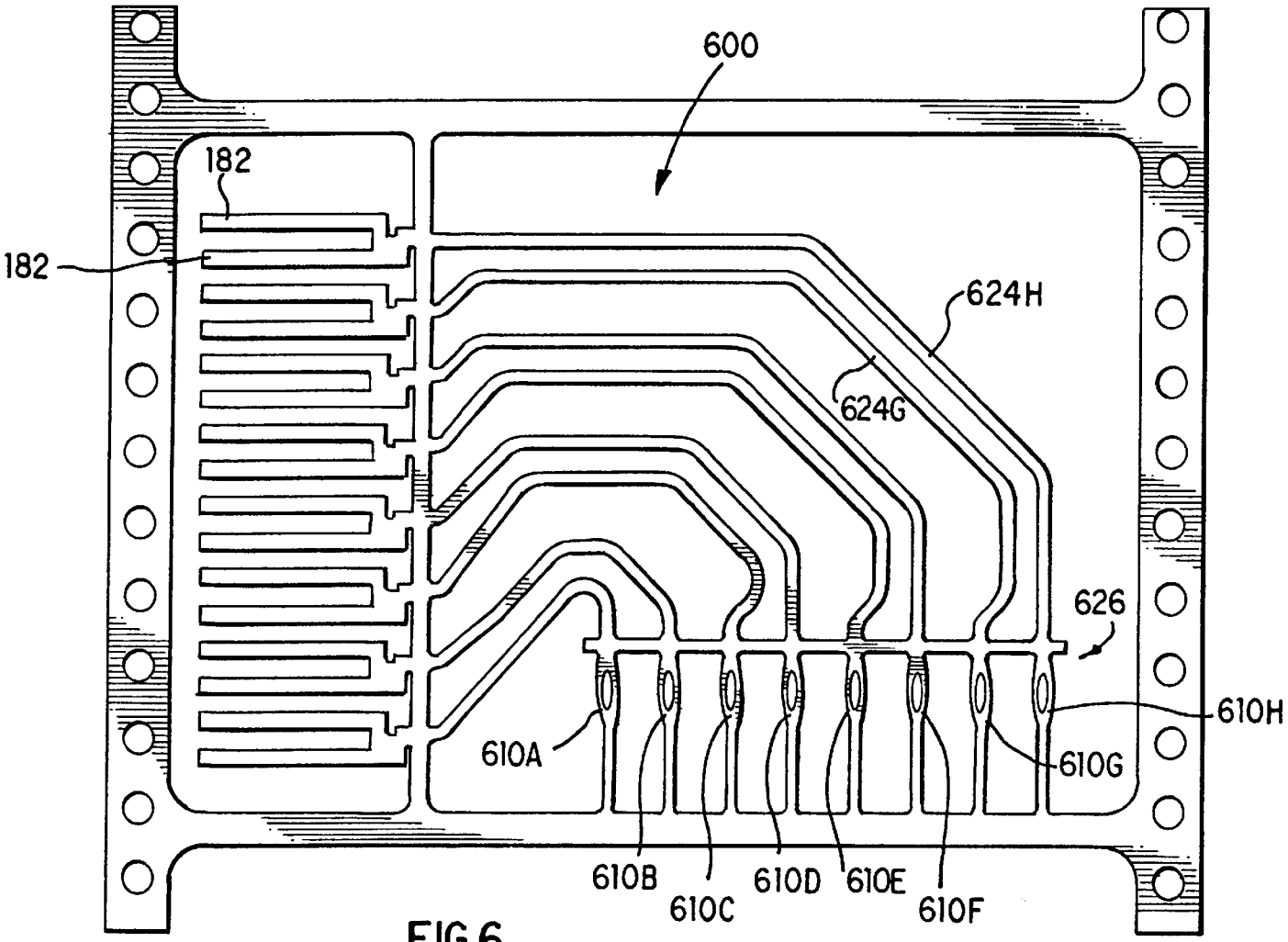
FIG. 6 is an alternative embodiment of the signal contact blank of FIG. 4 suitable for use in making a differential module.

FIG. 6 shows a receptacle contact blank 600 suitable for use in an alternative embodiment of the invention. Receptacle contacts 610A . . . 610H are grouped in pairs: (610A and 610B), (610C and 610D), (610E and 610F) and (610G and 610H). Transmission regions 624 of each pair are as close together as possible while maintaining differential impedance. This increases the spacing between adjacent pairs. This configuration improves the signal integrity for differential signals.

The tail region 626 and the receptacles of receptacle contact blank 400 and 600 are identical. These are the only portions of receptacle contacts 410 and 610 extending from housing 172. Thus, externally, signal portion 168 is the same for either single ended or differential signals. This allows single ended and differential signal wafers to be mixed in a single daughter card connector.

Figure 7B:
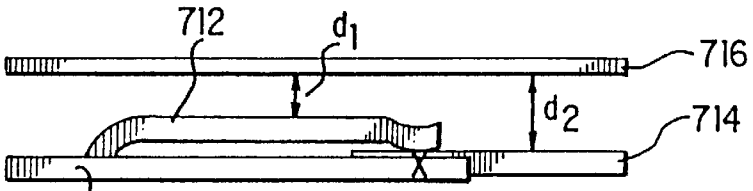
FIG.7B PRIOR ART
FIGS. 7A–7C are operational views a prior art connector.
Figure 7C:
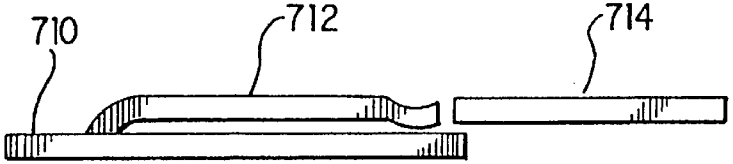
FIG.7C PRIOR ART
Figure 7A:
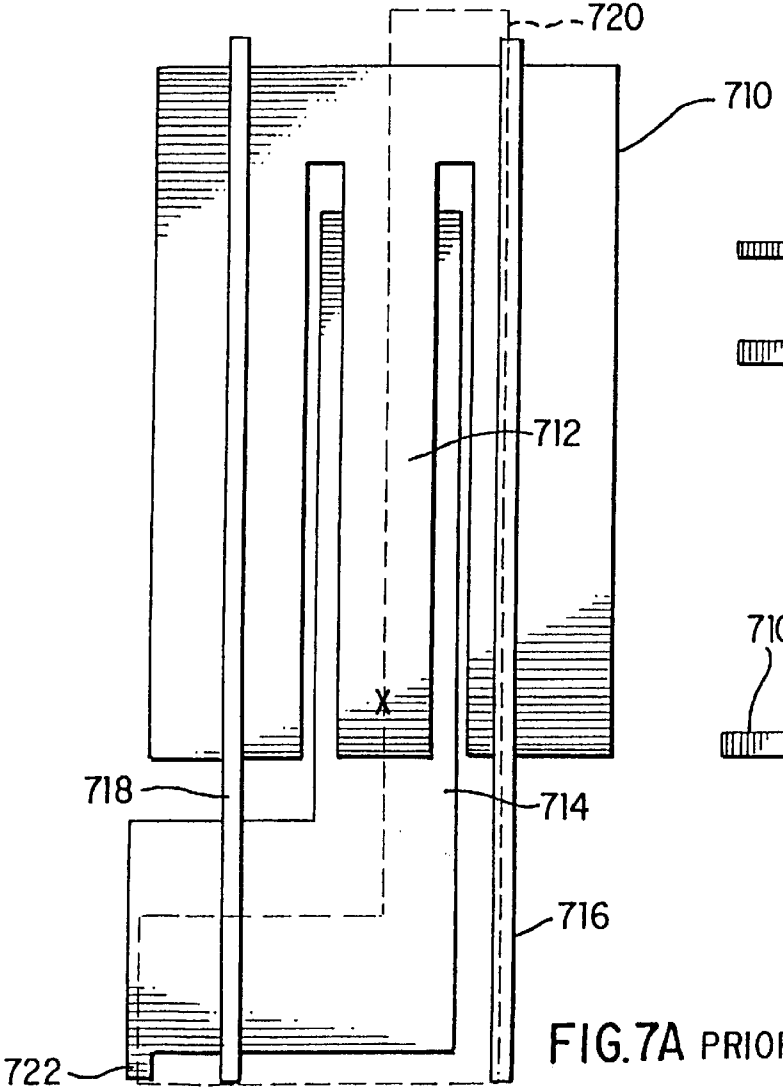
FIG.7A PRIOR ART

FIG. 7A illustrates a prior art connector as an aid in explaining the improved performance of the invention. FIG. 7A shows a shield plate 710 with a cantilevered beam 712 formed in it. The cantilevered beam 712 engages a blade 714 from the pin header. The point of contact is labeled X. Blade 714 is connected to a backplane (not shown) at point 722.

Signals are transmitted through signal pins 716 and 718 running adjacent to the shield plate. Plate 710 and blade 714 act as the signal return. The signal path 720 through these elements is shown as a loop. It should be noted that signal path 720 cuts through pin 718. As is well known, a signal traveling in a loop passing through a conductor will inductively couple to the conductor. Thus, the arrangement of FIG. 7A will have relatively high coupling or cross talk from pin 716 to 718.

FIG. 7B shows a side view of the arrangement of FIG. 7A. As the cantilevered beam 712 is above the blade 714 its distance from pin 716 is dl. In contrast, blade 714 has a spacing of d2, which is larger. In the transmission of high frequency signals, the distance between the signal path and the ground dictates the impedance of the signal path. Changes in distance mean changes in impedance. Changes in impedance cause signal reflections, which is undesirable.

FIG. 7C shows the same arrangement upon mating. The blade 714 must slide under cantilevered beam 712. If not inserted correctly, blade 714 can but up against the end of cantilevered beam 712. This phenomenon is called "stubbing." It is highly undesirable in a connector because it can break the connector.

Figure 8A:
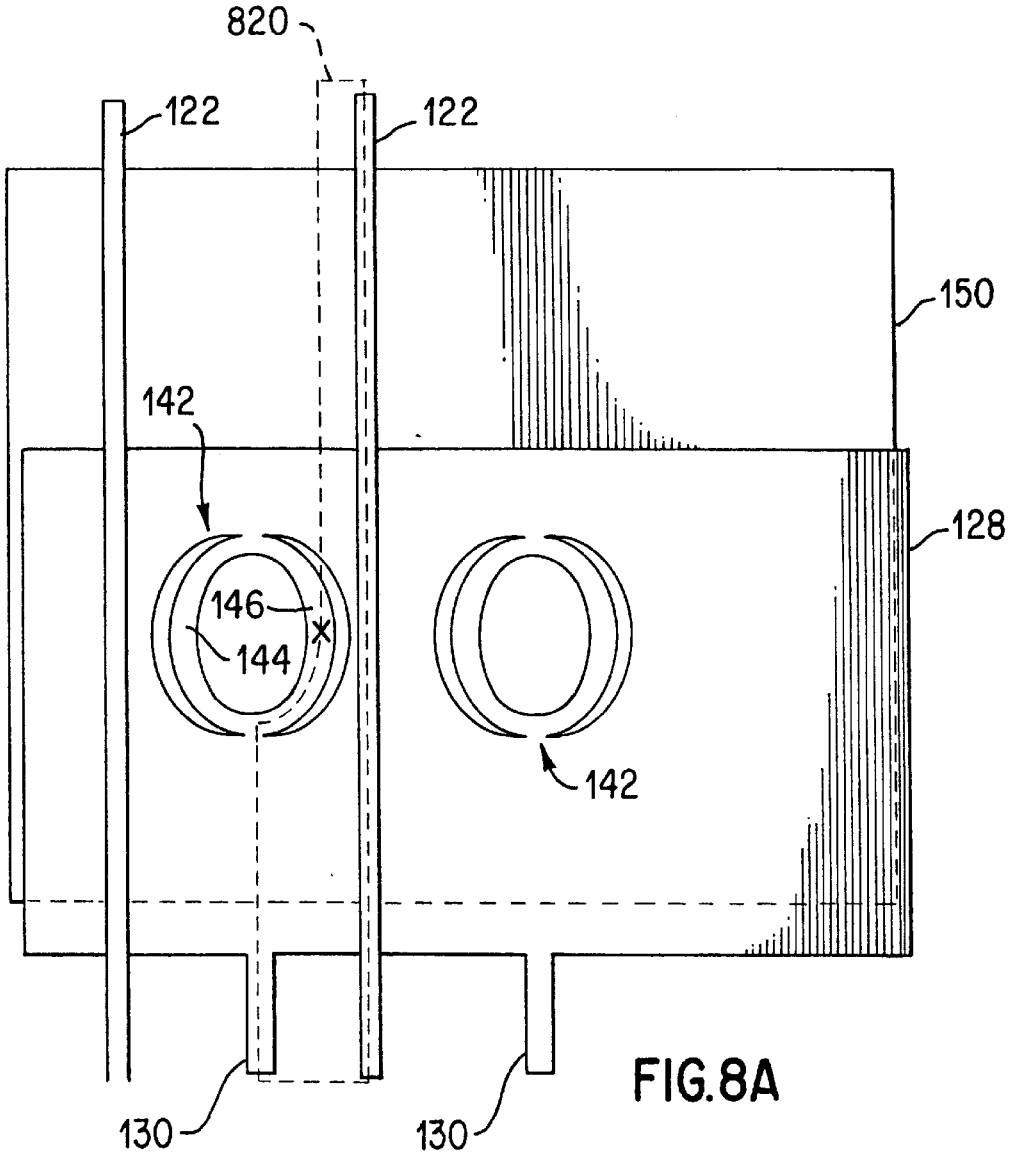
FIGS. 8A–8C are similar operational views of the connector of FIG. 1.

In contrast, FIG. 8 shows in a schematic sense the components of a connector manufactured according to the invention. Shield plates 128 and 150 overlap. Contact is made at the point marked X on torsional beam 146. Signal path 820 is shown to pass through a signal pin 122, return through plate 150 to point of contact X, pass through arm 146, through plate 128 and through tail 130. Signal path 820 is then completed through the backplane (not shown in FIG. 8). Significantly, signal path 820 does not cut through any adjacent signal pin 122. In this way, cross talk is significantly reduced over the prior art.

Figure 8B:
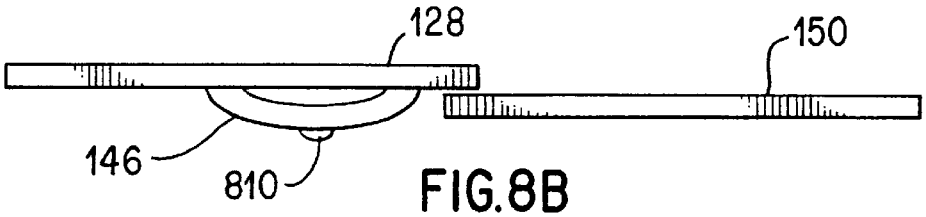

FIG. 8B illustrates schematically plates 128 and 150 prior to mating of daughter card connector 116 to pin header 114. In the perspective of FIG. 8B, arm 146 is shown bent out of the plane of plate 128. As plates 150 and 128 slide along one another during mating, arm 146 is pressed back into the plane of plate 128.

Figure 8C:
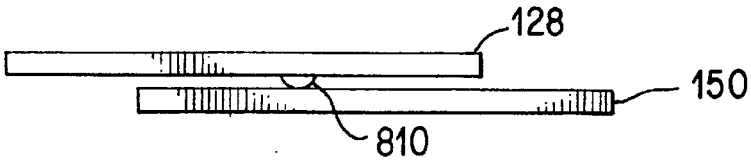

FIG. 8C show plates 128 and 150 in the mated configuration. Dimple 810 pressed into arm 146 is shown touching plate 150. The torsional spring force generated by pressing arm 146 back into the plane of plate 128 ensures a good electrical contact. It should be noted that the spacing between the plates 128 or 150 and an adjacent signal contact do not have as large a discontinuity as shown in FIG. 7B. This improvement should improve the electrical performance of the connector.

It should also be noted that in moving from the configuration of FIG. 8B to FIG. 8C, there is not an abrupt surface that could lead to stubbing. Thus, with torsional contacts, the mechanical robustness of the connector should be improved in comparison to the prior art.

Figure 10:
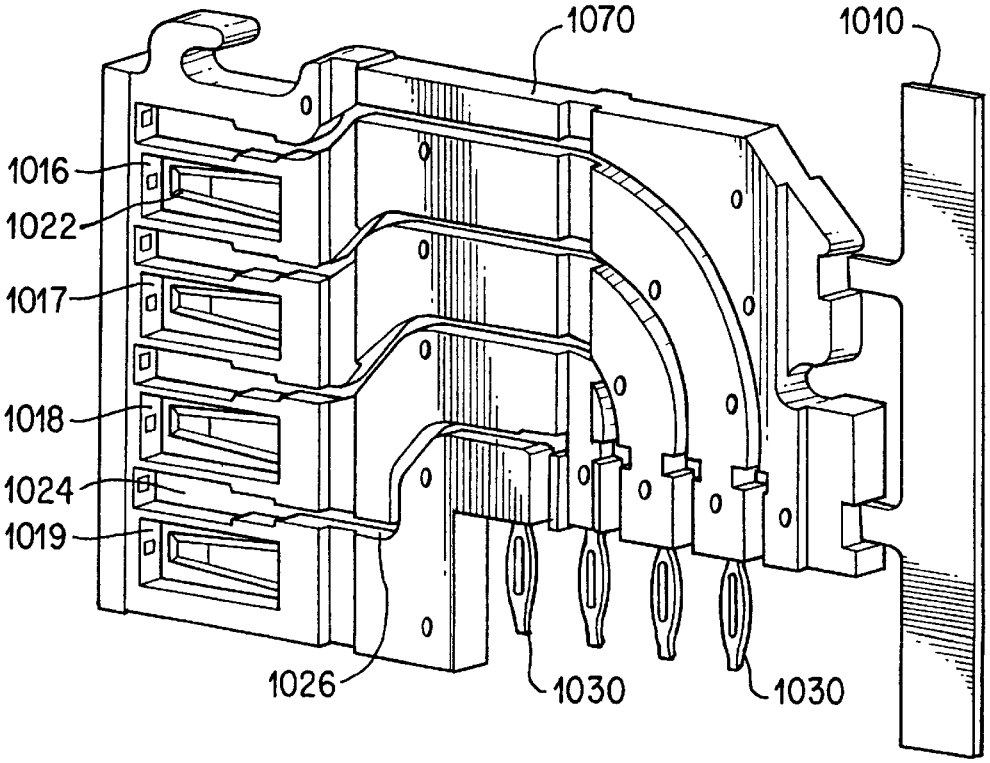
FIG. 10 is a view of an alternative embodiment of the invention.

FIG. 10 shows an alternative embodiment of a wafer 154 (FIG. 1). In the embodiment of FIG. 10, a shield blank on carrier strip 1010 is encapsulated in an insulative housing 1070 through injection molding. Shield tails 1030 are shown extending from housing 1070. Housing 1070 includes cavities 1016, 1017, 1018 and 1019. The shield blank is cut and bent to make contacts 1020 within cavities 1016, 1017, 1018 and 1019.

Cavities 1016, 1017, 1018 and 1019 have holes 1022 formed in their floors. Pins from the pin header are inserted through the holes during mating and engage, through the springiness of the pin as well as of contacts 1020 ensure electrical connection to the shield.

In the embodiment of FIG. 10, the signal contacts are stamped separately. The transmission line section of the contacts are laid into cavities 1026. The receptacle portions of the signal contacts are inserted into cavities 1024.

A wafer as in FIG. 10 illustrates that any number of signal contacts might be used per column. In FIG. 10, four signal contacts per column are shown. That figure also illustrates that pins might be used in place of a plate 128. However, there might be differences in electrical performance. A plate could be used in conjunction with the configuration of FIG. 10. In that case, instead of a series of separate holes 1022 in cavities 1016, 1017, 1018 and 1019, a slot would be cut through the cavities.

Figure 11A:
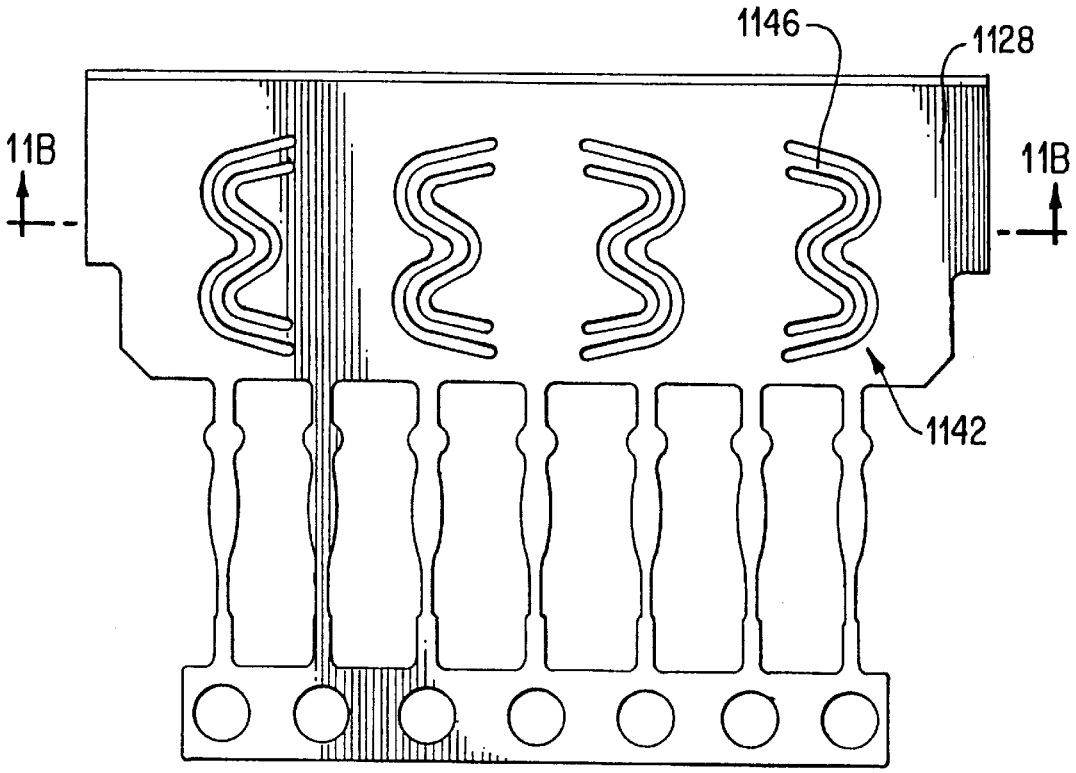
FIG. 11A is a an alternative embodiment for the plate 128 in FIG. 1.

FIG. 11A shows an alternative embodiment for contacts 142 on plate 128. Plate 1128 includes a series of torsional contacts 142. Each contact is made by stamping an arm 1146 from plate 1128. Here the arms have a generally serpentine shape. As described above, it is desirable for the arms 146 to be long enough to provide good flexibility. However, it is also desirable for the current to flow through the contacts 1142 in an area that is as narrow as possible in a direction perpendicular to the flow of current through signal pins 122. To achieve both of these goals, arms 1146 are stamped in a serpentine shape.

Figure 11B:
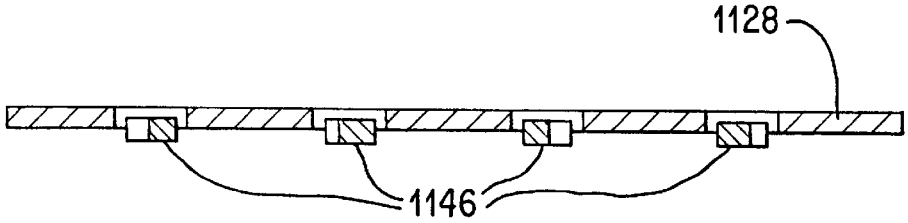
FIG. 11B is a cross sectional view taken through the line B—B of FIG. 11A.

FIG. 11B shows plate 1128 in cross section through the line indicated as B—B in FIG. 1A. As shown, arms 1146 are bent out of the plane of plate 1128. During mating of the connector half, they are pressed back into the plane of plate 1128, thereby generating a torsional force.

Figure 12:
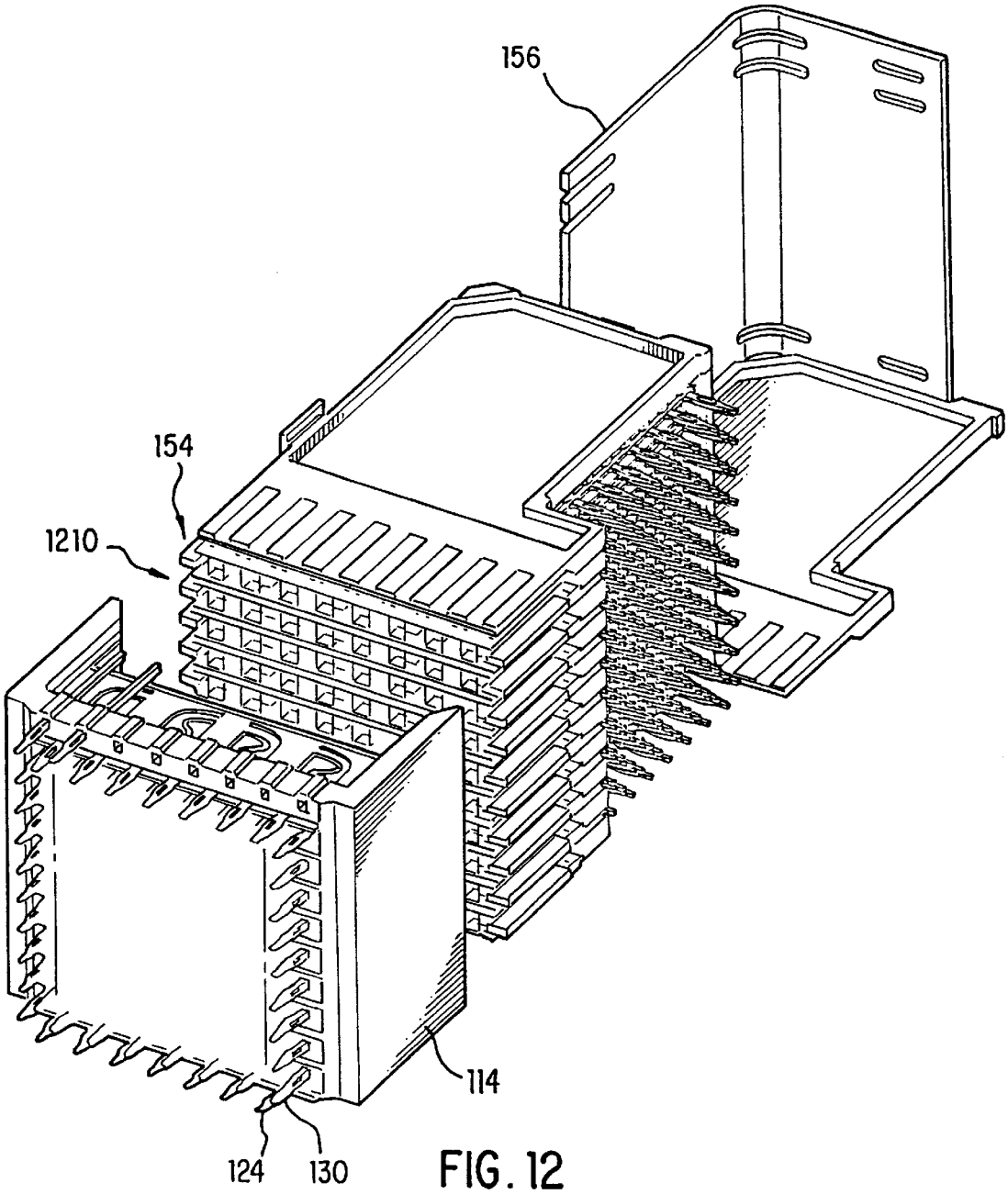
FIG. 12 is an isometric view of a connector according to the invention.

FIG. 12 shows an additional view of connector 100. FIG. 12 shows face 1210 of daughter card connector 116. The lower surface of pin header 114 is also visible. In this view, it can be seen that the press fit tails 124 of plate 128 have an orientation that is at right angles to the orientation of press fit tails 130 of signal pins 122.

EXAMPLE

A connector made according to the invention was made and tested. The test was made with the single ended configuration and measurements were made on one signal line with the ten closest lines driven. For signal rise times of 500 ps, the backward crosstalk was 4.9%. The forward cross talk was 3.2%. The reflection was too small to measure. The connector provided a real signal density of 101 per linear inch.

Having described one embodiment, numerous alternative embodiments or variations might be made. For example, the size of the connector could be increased or decreased from what is shown. Also, it is possible that materials other than those expressly mentioned could be used to construct the connector.

Various changes might be made to the specific structures. For example, clips 174 are shown generally to be radially symmetrical. It might improve the effectiveness of the shield plate 150 if clips 174 were elongated with a major axis running parallel with the signal contacts in signal pieces 168 and a perpendicular minor axis which is as short as possible.

Also, manufacturing techniques might be varied. For example, it is described that daughter card connector 116 is formed by organizing a plurality of wafers onto a stiffener. It might be possible that an equivalent structure might be formed by inserting a plurality of shield pieces and signal receptacles into a molded housing.

Therefore, the invention should be limited only by the spirit and scope of the appended claims.

What is claimed is:

1. An electrical connector comprising:

a plurality of wafers aligned in parallel, each wafer comprising:

a) a shield plate;

b) an insulative housing molded over a portion of the shield plate, the insulative housing having a plurality of cavities formed therein; and c) a plurality of signal receptacle contacts insert molded into a second insulative housing, each of said plurality of signal receptacle contacts inserted into one of the cavities.

2. The electrical connector of claim 1 wherein:

a) for a portion of the wafers, a spacing between adjacent signal receptacle contacts in each wafer is uniform; and b) for a portion of the wafers the signal receptacle contacts in each of the wafers are disposed in pairs with a spacing between signal receptacle contacts within a pair being less than a spacing between signal receptacle contacts in different pairs.

3. The electrical connector of claim 1 wherein the spacing between adjacent signal receptacle contacts in each wafer is uniform.

4. The electrical connector of claim 1 wherein the signal receptacle contacts in each of the wafers are disposed in pairs with a spacing between signal receptacle contacts within a pair being less than a spacing between signal receptacle contacts in different pairs.

5. The electrical connector of claim 1 wherein:

a) each shield plate includes a retention feature; and b) each of the second housings includes a feature engaging the retention feature in the shield plate.

6. The electrical connector of claim 1 wherein the second housing includes means for engaging the first housing.

7. The electrical connector of claim 1 additionally comprising a metal stiffener, wherein each of the wafers is attached to the stiffener.

8. The electrical connector of claim 1 wherein the plurality of signal receptacle contacts have tail portions for connection to a printed circuit board extending in parallel from the wafer and each shield plate includes a plurality of tail portions extending from the wafer in parallel with the tail portions of the signal receptacle contacts.

9. The electrical connector of claim 8 wherein the plurality of tail portions extending from each shield plate are attached in a first region of the shield plate, the first region of the shield plate parallel to but bent out of a plane defined by the portion of the shield plate molded into the insulative housing.

10. The electrical connector of claim 1 wherein each cavity is bounded by a wall having a hole formed therethrough.

11. The electrical connector of claim 9 wherein:

a) one wall of each cavity has a platform extending from the wall, b) each signal receptacle contact includes a pair of legs; and c) a first leg of each pair is on a first side of the platform and a second leg of each pair is on a second, opposing side of the platform.

12. The electrical connector of claim 1 wherein the insulative housing on each wafer is shaped to leave a cavity between adjacent wafers with one wall of said cavity being bounded by a shield plate of one of the adjacent wafers.

13. The electrical connector of claim 12 wherein each shield plate has a plurality of fingers attached thereto, said fingers projecting into the cavity.

* * * * *